US005579658A

United States Patent [19]

Noe et al.

[11] Patent Number: 5,579,658

[45] Date of Patent: Dec. 3, 1996

[54] METHOD OF AND APPARATUS FOR PRODUCING LARGE METAL PLATES

[75] Inventors: Oskar Noe; Rolf Noe; Andreas Noe, all of Mülheim, Germany

[73] Assignee: BWG Berkwerk-und Walzwerk-Maschinenbau GmbH, Duisburg, Germany

[21] Appl. No.: 534,980

[22] Filed: Sep. 28, 1995

[30] Foreign Application Priority Data

Oct. 22, 1994 [DE] Germany ..... 44 37 872.6

[51] Int. Cl.[6] ..... B21D 1/05

[52] U.S. Cl. ..... 72/130; 72/161; 72/202; 72/205; 72/294; 72/302

[58] Field of Search ..... 72/161, 302, 205, 72/202, 342.1, 342.94, 200, 130, 131, 294

[56] References Cited

U.S. PATENT DOCUMENTS 3,429,164 2/1969 Oganowski ..... 72/205
3,686,921 8/1972 Roper ..... 72/161
3,722,251 3/1973 Withrow ..... 72/302
4,751,838 6/1988 Voges ..... 72/302

FOREIGN PATENT DOCUMENTS 108418 4/1990 Japan ..... 72/205

*Primary Examiner*—Daniel C. Crane
*Attorney, Agent, or Firm*—Herbert Dubno

[57] ABSTRACT

Method and apparatus for producing large-area metal, especially steel, plates. The metal strip unwound from a coil is continuously treated by a heat treatment followed by stretch-bend leveling and then stretcher-leveling, the latter being discontinuously carried out by clamping the strip at two locations and urging those locations apart. Only subsequently is the strip cut to form the plates.

19 Claims, 2 Drawing Sheets

METHOD OF AND APPARATUS FOR PRODUCING LARGE METAL PLATES

FIELD OF THE INVENTION

Our present invention relates to a method and an apparatus for producing metal plates and, more particularly, large-area metal plates from rolled steel or other metal strip with a predetermined strip thickness.

BACKGROUND OF THE INVENTION

In the aircraft industry, in ship construction and in the building field, increasing quantities of metal plates and especially large-area metal plates of sizes of 2 m×6 m and thicknesses of 3 mm to 15 mm are used. In the past, such metal plates could be formed in part by a hot rolling and, following the cooling steps in the hot rolling process, tended to have natural stresses. These could be largely eliminated by a heat treatment. After this heat treatment, tempering and cooling, the metal plates were generally no longer planar.

Because of the strict requirements for planarity for such plates, the metal plates were generally subjected to leveling in stationary roll-levelers and tension-levelers in a discontinuous manner. During mechanical handling and especially during machining operations resulting in material removal, the metal plates tended to develop faults and bulges which resulted in a loss of planarity and which could not satisfactorily be eliminated by local leveling operations.

By and large the tension-leveling of the individual plates was effected above the yield point to achieve a sufficient degree of freedom from internal stresses.

During the heat treatment and during the tension-leveling, the metal plate must be clamped under tension and the same applies in the cutting of the metal plates into smaller pieces or desired shapes. Where the metal plate was clamped, frequently along an entire edge of the metal plate, e.g. the length or width, the clamped portion was cut off to eliminate any defects resulting from the clamping engagement with the plate. The same applies for the transition regions between the clamping zones and the remainder of the plate so that throughout a constant cross section of the plate can be assured.

This gives rise to substantial losses of the steel or other metal of the plate. For all of these additional steps, corresponding transport and storage of the metal plates is required, thereby increasing the production cost and making the prior method of producing such plates relatively uneconomical.

OBJECTS OF THE INVENTION

It is, therefore, the principal object of the present invention to provide an improved method of making metal plates, especially large-area metal plates, like steel plates, whereby the drawbacks of earlier systems are avoided, the method is more economical, and excess plate storage transport is avoided.

Another object of the invention is to provide an improved method of making large-area steel and other metal plates, whereby the losses are minimized and a high quality product can be obtained.

SUMMARY OF THE INVENTION

These objects and others which will become apparent hereinafter are attained, in accordance with the invention, with a continuous method for the fabrication of steel or other metal plates or, stated otherwise, a method which uses the continuous treatment of the metal stock in the form of continuous strip. According to the invention, the steel or other metal strip is, along a continuous processing line, subjected to a heat-treatment or annealing to reduce stresses continuously in this line and is then, subsequent to the annealing, subjected to stretch-bend leveling, and after the stretch-bend leveling in a discontinuous manner is tension-leveled while part of the continuous strip. The strip is cut into sections of the desired plate size after the tension-leveling.

Stretch-bend leveling is described in the *Making, Shaping and Treating Steel,* United States Steel Company, Tenth Edition, 1985, at page 1096 (roller leveling) and page 1119, while stretch leveling (stretcher leveler) is described at page 1096).

In stretch-bend leveling, the strip is passed over and under alternating rollers which each deflect the strip in an opposite direction from the deflection direction of the previous roller and the degree of which the rollers are positioned to deflect the strip to the opposite of a median plane is a measure of the extent of stretch-bend leveling. In the stretcher leveler or stretch-leveling step, spaced-apart parts of the strip are clamped and the clamps are moved relatively apart.

According to the invention, the hot-rolled or cold-rolled strip need not only be composed of steel. Rather the principles of the invention are applicable to such metals as aluminum, copper, brass or alloys thereof as well. The steel or metal strip can have lengths of 100 m to about 1200 m and can be supplied to the process of the invention in coils. The steel or other metal strip can be passed through the stations for heat treatment and stretch-bend leveling continuously (conti-line) and only in a discontinuous portion of the line is it cut into plates following tension-leveling or stretcher-leveling and finally stacked.

Heat-treatment of the steel or other metal strip in a low-tension annealing operation with subsequent air cooling or quenching with water is extraordinarily difficult and can itself generate internal stresses and dislocations. For that reason, following the stretch-bend leveling step of the invention, shape changes can be corrected and the requisite planarity restored. Since the strip may have residual bending stresses following the stretch-bend leveling step, experienced as compression stresses on the surface of this strip and as tension stresses in the core thereof such that these stresses are in equilibrium, it is desirable to so carry out the stretcher-leveling (tension-leveling) which follows the stretch-bend leveling, that these residual bending stresses are eliminated.

With thicker steel or other metal plates, up to a thickness of 2 mm, a simple heating treatment followed by stretch-bend leveling can suffice to yield the desired planarity and freedom from internal stresses when the steel or other metal strips develop primarily a tensile stress during the stretch-bend leveling and only is subjected to secondary bending stresses. Here as well, the stretch-bend leveling is ultimately followed by a stretcher or tension-leveling operation. The steel or other metal strip can be cut into plates without a discontinuous stretcher leveling if desired.

More specifically, a method of producing large metal plates according to the invention can comprise:

(a) feeding a continuous rolled metal strip along a transport path;

(b) heat treating-the continuous metal strip as it is advanced continuously along the path to reduce stresses in the continuous metal strip;

(c) stretch-bend leveling the continuous metal strip as it is advanced continuously along the path subsequent to the heat treating thereof in step (b);

(d) thereafter discontinuously stretch leveling the continuous metal strip at a location along the path downstream from the stretch-bend leveling thereof by gripping successive portions of the strip at spaced-apart regions and linearly stretching the portions apart to a predetermined extent; and (e) cutting the strip into sheets following the stretch leveling of the strip in step (d).

Advantageously the continuous metal strip as obtained from a coil is leveled to eliminate any coil set thereof prior to the heat treatment of the invention.

It has been found to be advantageous to pretrim longitudinal edges of the strip after the leveling thereof to eliminate coil set but before heat treating the strip. Longitudinal edges of the strip can be finely trimmed prior to the cutting of the strip into plates. Advantageously, the strip is discontinuously stretch-leveled by stretching the strip between the clamp by 0.5 to 3.0%. Advantageously, successive overlapping portions of the strip are stretch-leveled and, in conjunction with the final trimming and cutting of the sheets, the gripped or clamped portions are cut away.

In still another feature of the invention the strip is dressed prior to stretch-bend leveling thereof. The dressing operation is advantageously a rolling operation in which the strip is cold-rolled between rolls set so as to maintain the thickness or to slightly reduce the thickness. A measure of the degree of the dressing operation is the percentage reduction in the thickness of the metal strip.

As has been indicated, the strip can be provided with a thickness up to 8 mm, a width up to 3,000 mm and the treated strip can be cut up into plates with lengths up to 20,000 mm. In a preferred mode of the invention steel strip is used in a width of 60,000 mm to 3,000 mm and a thickness of 3 mm to 15 mm.

Before heating treatment of the strip, longitudinal edges may be trimmed away and longitudinal edges of the strip may be trimmed off prior to the cutting of the strip.

An apparatus according to the invention for producing large metal plates can comprise:

means for feeding a continuous rolled metal strip along a transport path;

means for heat treating the continuous metal strip as it is advanced continuously along the path to reduce stresses in the continuous metal strip;

a stretch-bend leveler downstream of the means for heat treating along the path for stretch leveling the continuous metal strip as it is advanced continuously along the path subsequent to the heat treating thereof;

means downstream of the stretch-bend leveler for discontinuously stretch leveling the continuous metal strip at a location along the path downstream from the stretch-bend leveling thereof by gripping successive portions of the strip at spaced-apart regions and linearly stretching the portions apart to a predetermined extent; and a cutter downstream of the stretch leveling means along the path for cutting the strip into sheets following the stretch leveling of the strip.

Advantageously, a leveler upstream of the heat-treating means can be provided for eliminating coil set in the apparatus. The latter can also include the dressing stand with the dressing rolls along the continuous path of the strip upstream of the stretch-bend leveler.

A trimmer can be provided between the stretch leveler and the cutter. Means can be provided for pretrimming longitudinal edges of the strip after he leveling thereof but before heat-treating of the strip.

In practice, the marking of the strip by the overlapping clamping and stretcher leveling thereof can ensure that each clamping location side at an upstream side that coincides with the clamping location at the downstream side for the next section, thereby reducing material losses on trimming and cutting out of the plates by 50%. The strip preferably has a thickness of about 3 mm.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
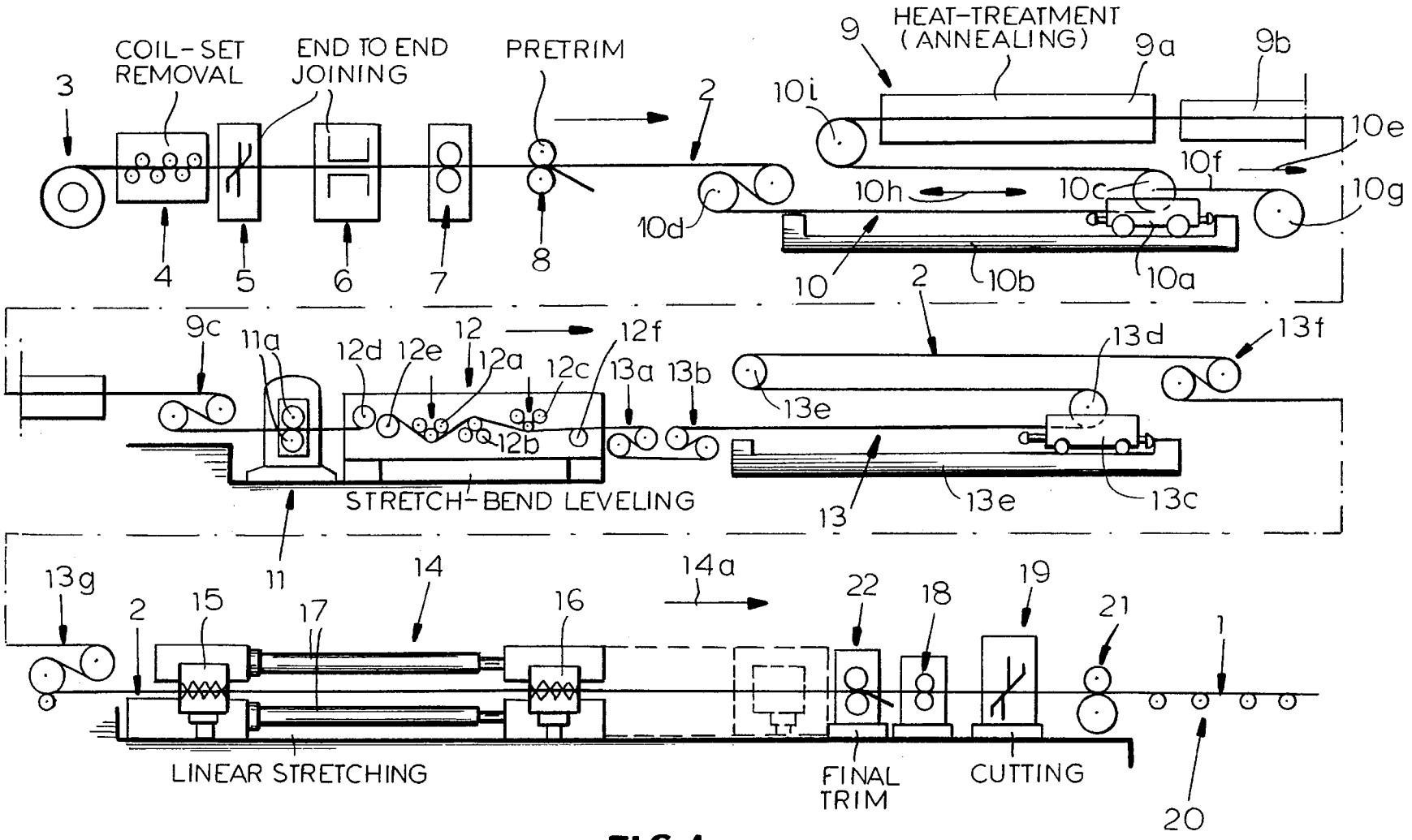
FIG. 1 is a schematic side view of a strip line for carrying out the method of the invention.

In the drawing, we have shown an apparatus for producing metal plates, especially large-area metal plates and particularly steel and other metal plates from hot-rolled or cold-rolled steel or metal strip 2. The plates themselves are shown at 1 in FIG. 1 and appear at the end of the line.

At the upstream end of the line, an uncoiler or unwinder 3 at which a coil of the hot-rolled or cold-rolled strip is unwound and fed as the continuous strip 2 initially through a roller leveler 4 acting as a coil-set remover.

The uncoiler can be of the type described at pages 1146, 1149 and 1182 of *The Making, Shaping and Treating of Steel*. The stretch-bend leveler 4 can be of the type described at page 1096 for the roller leveler thereof.

From the stretch-bend leveler 4, the strip 1 passes through a shear 5 followed by a strip-joining unit or welder 6.

The shear 5 represents a device for trimming the trailing edge from a depleted coil and the leading edge of a strip from a new coil so that these edges can be butt-welded to provide a continuous strip using the welder 6. The shear and welder can be used to cut defective portions out of the strip as well.

From the end-to-end joining station 5, 6, the strip passes through a pre-edging unit 8 which serves to trim the longitudinal edges of the strip and likewise remove potentially defective portions thereof. The strip is advanced between a pair of driving rolls in the driver unit 7.

The strip then passes through a heat-treatment or annealing device 9 containing an annealing stage **9*a* and a curing stage 9*b*. Upstream of the annealing stage and the heat-treatment unit 9 is a strip-storage unit 10 which can comprise a looper car 10*a* displaceable on a looper bed 10*b* and carrying a looper roll 10*c* about which the strip passes from a bridle 10*d*. The looper car is drawn in the direction of arrow 10*e* by a flexible member 10*b* on a windless 10*g*. The displacement of the looper car 10*a* as represented by the arrow 10*h* allows the loop of the strip to be increased and decreased to ensure continuous feed of the strip and yet allow control of the speed with which the strip is paid off the coil and control of the speed of the strip through the heat-treating unit 9. The looper 10 comprises an additional roller 10*e*** about which the strip passes before it enters the heat-treating unit.

The use of a looper car in this manner is described in commonly-owned copending application Ser. No. 08/333,556 filed Nov. 2, 1994.

Downstream of the heat-treatment unit 9 is a further bridle 9*c* intended to ensure that tension is maintained on the strip. This tension is required for a strip-bend leveler 12 downstream of the heat-treatment unit 9. Between the stretch-bend leveler 12 and the heat-treatment unit 9, a dressing frame 11 is provided. The rolls 11*a* of this dressing or rolling stand engage the strip and can slightly reduce the thickness thereof. The stretch-bend leveler 12 which can operate under the principles of roller leveling under tension described at pages 1096 and 1119 of *The Making, Shaping and Treating of Steel,* can have several sets 12*a*, 12*b* and 12*c* of rollers deflecting the highly tensioned strip alternately to opposite sides of a median plane.

The strip 2 passes between two rolls 12*d* and 12*e* at the inlet of the stretch-bend leveler and flat roller 12*f* at the outlet thereof before the strip is engaged in a pair of bridles 13*a* and 13*b* upstream of a further strip storage unit.

The strip-storage unit 13 also has a looper car 13*c* carrying a looper-roll 13*d* about which the strip is looped and guided on a bed 13*e*. From the looper car 13*c*, the strip passes over a direction-change roller 13*e* to a bridle 13*f* maintaining the tension on the strip until it reaches a further bridle 13*g* at the inlet to the linear stretcher or stretcher leveler 14.

The stretch leveler 14 has a stationary clamping jaw 15 and a movable clamping jaw 16 which can be displaced by hydraulic or pneumatic cylinders 17 in the direction 14*a* of advance of the strip and in the stretching direction. The stroke of the stretcher leveler has been indicated in broken lines. Following the stretcher leveler 14 is a final-trimming unit followed by a driver 18 engaging the strip between the two rollers, the cutting unit 19 which cuts up the strip into the plates, and a roller-conveyor 20 for carrying off the plates cut to the desired dimensions. A plate feeder 21 comprising a pair of driving rollers, engages the plates downstream of the cutter 19.

Figure 2:
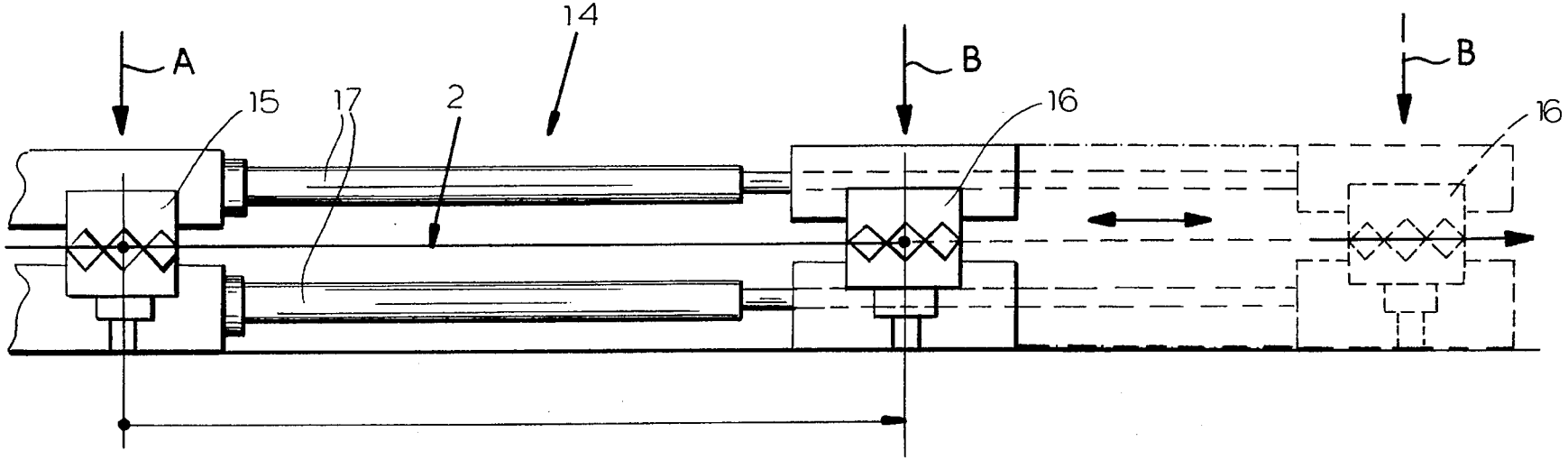
FIG. 2 is a schematic illustration of the stretcher-leveling or tension-leveling unit with the overlapping clamping locations used in the apparatus of FIG. 1.

In the stretcher leveler 14 (see also FIG. 2), the metal is stretched while it is part of the strip. While the clamped portion of the strip at a is fixed, and a corresponding clamping mark can be produced on the strip, the strip can be engaged at b by the movable jaw at a location which corresponds to the prior clamping mark. The excessive clamping marks therefore coincide and the clamping locations overlap. The metal plates of the invention can have very large sizes and because they are primarily treated while part of the strip, the desired degree of planarity and freedom from stress can be obtained without undue handling of plates. When the strip is cut up to form the plates, the clamping regions a, b can be removed with a substantially reduced loss of material compared to the prior art. The high quality generated in the strip remains in the plates cut from the strip.

We claim:

1. A method of producing large metal sheets, said method comprising the steps of:

(a) feeding a continuous rolled metal strip along a transport path;

(b) heat treating said continuous metal strip as it is advanced continuously along said path to reduce stresses in said continuous metal strip;

(c) stretch-bend leveling said continuous metal strip as it is advanced continuously along said path subsequent to the heat treating thereof in step (b);

(d) thereafter discontinuously stretch leveling said continuous metal strip at a location along said path downstream from the stretch-bend leveling thereof by gripping successive portions of said strip at spaced-apart regions and linearly stretching said portions apart to a predetermined extent; and (e) cutting said strip into sheets following the stretch leveling of said strip in step (d).

2. The method defined in claim 1, further comprising the step of leveling said continuous metal strip as obtained from a coil to eliminate coil set thereof prior to heat treating said strip in step (b).

3. The method defined in claim 2, further comprising pretrimming longitudinal edges of the strip after the leveling thereof to eliminate coil set but before heat treating said strip in step (b), and finally trimming longitudinal edges of the strip prior to the cutting of said sheets in step (e).

4. The method defined in claim 3 wherein said strip is discontinuously stretch leveled in step (d) by stretching said strip between said portions by 0.5 to 3.0%.

5. The method defined in claim 4 wherein, in step (d), successive overlapping segments of said strip are stretch leveled and in conjunction with the final trimming and cutting of said sheets in step (e) gripped portions are cut away.

6. The method defined in claim 5, further comprising the step of dressing said strip prior to stretch-bend leveling thereof in step (c).

7. The method defined in claim 6 wherein said strip in step (a) is provided with a thickness up to 15 mm and with a width up to 3000 mm, said sheets being cut to lengths up to 20,000 mm.

8. The method defined in claim 7 wherein said strip is steel strip provided in a width of 600 mm to 3000 mm and a thickness of 3 mm to 15 mm.

9. The method defined in claim 1, further comprising pretrimming longitudinal edges of the strip before heat treating said strip in step (b), and finally trimming longitudinal edges of the strip prior to the cutting of said sheets in step (e).

10. The method defined in claim 1 wherein said strip is discontinuously stretch leveled in step (d) by stretching said strip between said portions by 0.5 to 3.0%.

11. The method defined in claim 1 wherein, in step (d), successive overlapping segments of said strip are stretch leveled and in conjunction with a final trimming and cutting of said sheets in step (e) gripped portions are cut away.

12. The method defined in claim 1, further comprising the step of dressing said strip prior to stretch-bend leveling thereof in step (c).

13. The method defined in claim 1 wherein said strip in step (a) is provided with a thickness up to 15 mm and with a width up to 3000 mm, said sheets being cut to lengths up to 20,000 mm.

14. The method defined in claim 1 wherein said strip is steel strip provided in a width of 600 mm to 3000 mm and a thickness of 3 mm to 15 mm.

15. An apparatus for producing large metal sheets, said apparatus comprising:

means for feeding a continuous rolled metal strip along a transport path;

means for heat treating said continuous metal strip as it is advanced continuously along said path to reduce stresses in said continuous metal strip;

a stretch-bend leveler downstream of said means for heat treating along said path for stretch leveling said continuous metal strip as it is advanced continuously along said path subsequent to the heat treating thereof;

means downstream of said stretch-bend leveler for discontinuously stretch leveling said continuous metal strip at a location along said path downstream from the stretch-bend leveling thereof by gripping successive portions of said strip at spaced-apart regions and linearly stretching said portions apart to a predetermined extent; and a cutter downstream of the stretch leveling means along said path for cutting said strip into sheets following the stretch leveling of said strip.

16. The apparatus defined in claim 15, further comprising a leveler upstream of said means for heat treating along said path for eliminating coil set in said apparatus.

17. The apparatus defined in claim 15, further comprising a dressing stand along said path upstream of said stretch-bend leveler.

18. The apparatus defined in claim 15, further comprising a trimmer between said means for stretch leveling and said cutter.

19. The apparatus defined in claim 15, further comprising means for pretrimming longitudinal edges of the strip after the leveling thereof but before heat treating of said strip.

* * * * *